United States Patent [19]

Tsai

[11] Patent Number: 4,831,749

[45] Date of Patent: May 23, 1989

[54] FOOTWEAR HAVING SINGLE-LAYER VENTILATING AND MASSAGING INSOLE

[75] Inventor: Chao-Hsiung Tsai, Chang-Hua Hsien, Taiwan

[73] Assignee: Jiuh Lung Enterprise Co., Ltd., Pan-Chiao City, Taiwan

[21] Appl. No.: 227,315

[22] Filed: Aug. 2, 1988

[51] Int. Cl.[4] ..... A43B 7/06; A43B 13/38; A43B 7/14

[52] U.S. Cl. ..... 36/3 B; 36/43; 128/582; 128/588

[58] Field of Search ..... 36/43, 44, 3 B, 3 R; 128/582, 588, 25 B

[56] References Cited

U.S. PATENT DOCUMENTS

| | | | |
|---|---|---|---|
| 3,757,774 | 9/1973 | Hatuno | 128/582 |
| 4,215,492 | 8/1980 | Sandmeier | 36/44 |
| 4,635,385 | 1/1987 | Ogden | 36/43 |
| 4,674,203 | 6/1987 | Föller | 36/44 |

FOREIGN PATENT DOCUMENTS

| | | | |
|---|---|---|---|
| 2024534 | 12/1971 | Fed. Rep. of Germany | 36/44 |
| 1142786 | 4/1957 | France | 128/588 |
| 2193426 | 2/1988 | United Kingdom | 36/43 |

OTHER PUBLICATIONS 84 15720, 9/6/1984, Germany Utility Model, Heinrich.

*Primary Examiner*—James Kee Chi

[57] ABSTRACT

A footwear includes a ventilating and massaging insole having a plurality of upper beads protruding upwardly to touch a wearer's foot and a plurality of lower beads protruding downwardly to ride on a footwear sole so that upon a dpression of a wearer's foot on the insole, an air flow will be pumped through holes each hole formed between each upper bead and each lower bead for ventilating the wearer's foot and for massaging the same.

4 Claims, 2 Drawing Sheets

FOOTWEAR HAVING SINGLE-LAYER VENTILATING AND MASSAGING INSOLE

BACKGROUND OF THE INVENTION

Sandmeier disclosed a removable inner sole for footwear in his U.S. Pat. No. 4,215,492 which includes an interior chamber for the forced flow of air unobstructed and uninterruptedly between the heel and toe portions thereof and through inlet and outlet openings.

The inner sole comprises two overlaid members having a U-shaped spacer interposed the sole members along the marginal edges of the heel portion and having a plurality of protrusions integrally formed on the upper member near the toe portions.

However, such a conventional insole still has the following drawbacks:

1. For making a low cost footwear such as a slipper, the two-member insole will require a higher production cost, especially when bonding the spacer between the two members.

2. The plural protrusions formed on the insole are only disposed on the front portion near the toe portions and may not exert a better massage effect by such plural protrusions.

3. If the protrusions are widely spread to fully distribute on the upper member including the heel portion, the heel portion will be increased its height to discomfort a wearer's heel. Accordingly, the massage effect by Sandmeier's device is quite limited.

The present inventor has found the drawbacks of a conventional inner sole and invented the present single-layer ventilating and massaging insole.

SUMMARY OF THE INVENTION

The object of the present invention is to provide a footwear having an insole embedded in a footwear having a plurality of upper beads protruding upwardly and a plurality of lower beads protruding downwardly, the upper beads being interlacedly adjacent to the lower beads and being separated with one another by a plurality of through holes therebetween, so that upon a loading by a wearer's foot on the insole, the upper beads will be depressed by the foot to pump air upwardly through the holes to ventilate a wearer's foot and also massage the same.

Figure 1:
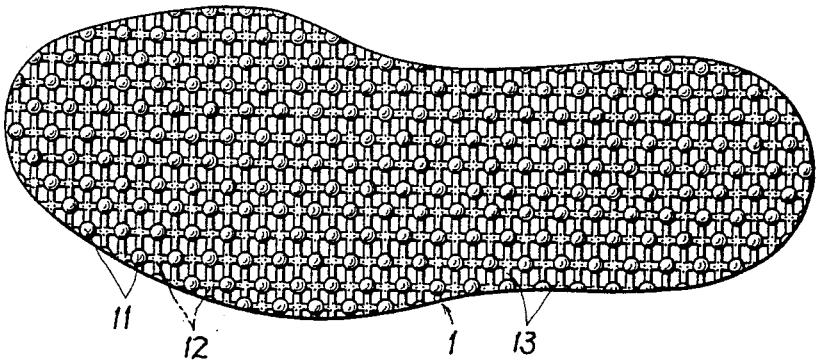
FIG. 1 is a top view illustration of the insole of the present invention.
Figure 2:
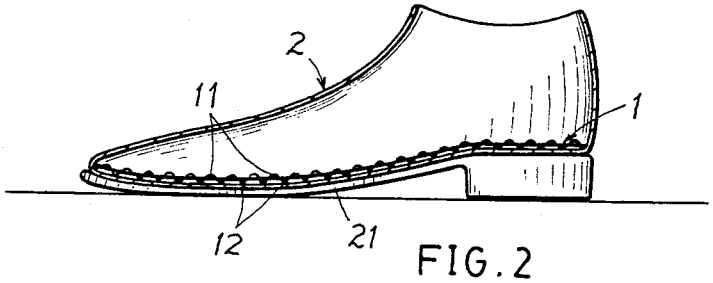
FIG. 2 is a sectional drawing of the present invention.
Figure 3:
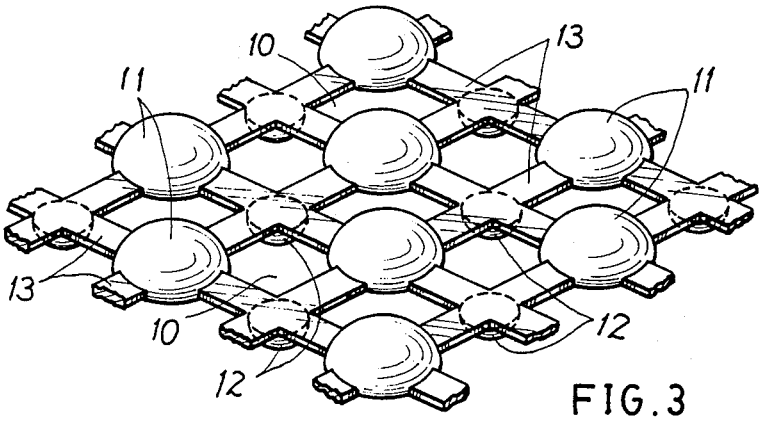
FIG. 3 is a perspective illustration showing the plurality of beads of the insole of the present invention.

The insole 1 includes: a plurality of upper beads 11 crossingly linked with a plurality of lower beads 12 by a plurality of strut members 13, thereby defining a plurality of through holes 10 among the beads 11, 12 and the strut members 13.

Each upper beads 11 is protruded upwardly and each lower bead 12 is protruded downwardly. The upper bead 11 is interlacedly adjacent to the lower bead 12 so that each upper bead 11 is diagonally surrounded by four lower beads 12, and each lower bead 12 is diagonally surrounded by four upper beads 11.

From a vertical projective view of the insole 1, the upper bead 11 is projectively separated (not overlapping) from the lower bead 12. The upper bead 11 may be formed with a larger cross section area than that of the lower bead. The shape of bead 11 or 12 of this invention is not limited, but is preferably made as a circular or spherical shape.

Figure 4:
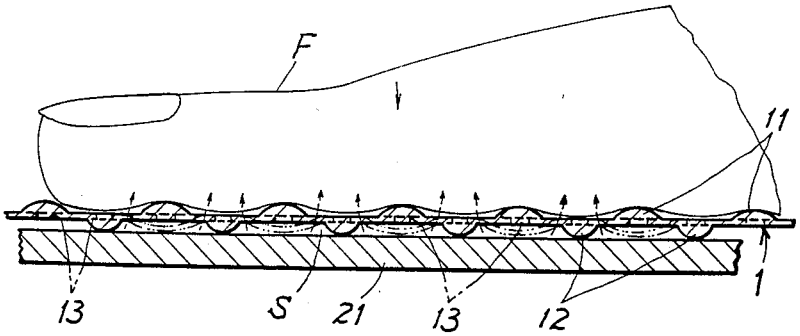
FIG. 4 is a partial sectional illustration of the present invention.

In using the present invention as shown in FIG. 4, a wearer's foot F will depress or sag the upper beads 11 downwardly against the supportng lower beads 12 riding on a footwear sole 21 as shown in dotted line of FIG. 4, to thereby pump an air stream upwardly for ventilating a wearer's foot and also massage the wearer's foot.

Figure 5:
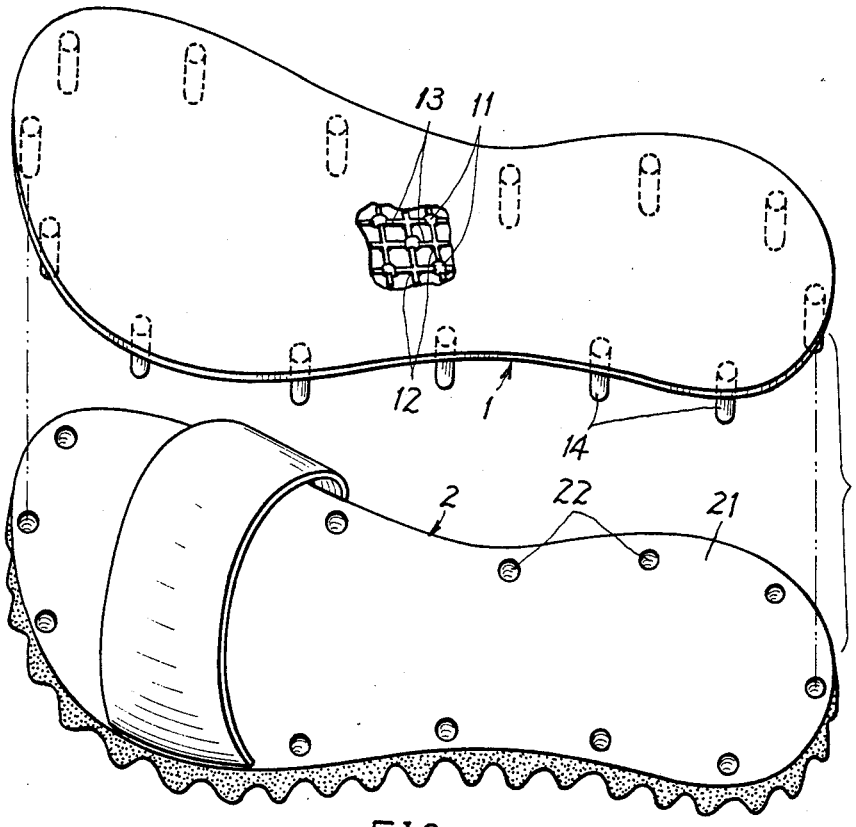
FIG. 5 shows another preferred embodiment of the present invention. DETAILED DESCRIPTION As shown in FIGS. 1–4, the present invention comprises: a single-layer insole 1 embedded into a footwear 2 and overlaid on a sole 21 of the footwear 2.

As shown in FIG. 5, the insloe 1 may be further formed with a plurality of bottom tenons 14 to correspondingly engage a plurality of sockets 22 formed in the sole 21 of a footwear or a slipper 2 fot stabilizing the insole 1 on a footwear or slipper.

The present invention has the following advantages superior to a conventional ventilated insole or footwear embedded with a ventilated insole:

1. The insole 1 is a single sheet or layer for lower production cost, but having ventilation and massage effect simultaneously.

2. The upper bead 11 is projectively deviated from the lower bead 12 so that the wearer's foot will not be stuck or will not feel painful since a gravitational loading of the wearer's foot upon the upper beads 11 will be resiliently buffered by a space S among an upper bead 11, two neighboring lower beads 12 standing on the sole and the sole surface 21 (FIG. 4).

3. The ventilation can be simply effected by gravitationally squeezing the plural beads 11 to pump air upwardly through the holes 10 when treading a wearer's foot on a ground floor.

I claim:

1. A footwear having an insole embedded in the footwear and mounted on a sole of said footwear, said insole including: a plurality of upper beads protruding upwardly to be gravitationally depressed by a wearer's foot and a plurality of lower beads protruding downwardly to ride on a sole surface; each said upper bead being interlacedly separated or projectively deviated from each said lower bead so that each said upper bead is diagonally surrounded by four said lower beads and each said lower bead is diagonally surrounded by four said upper beads; each said upper bead being interlacedly adjacent to each said neighboring lower bead by a strut member; said plurality of upper beads, lower beads and strut members commonly defining a plurality of through holes therebetween, whereby upon a depression of a wearer's foot on said upper heads, an air flow is pumped upwardly through said through holes for ventilating the wearer's foot and for massaging the same.

2. A footwear according to claim 1, wherein said upper bead of said insole has a cross sectional area larger than a cross sectional area of said lower bead.

3. A footwear according to claim 1, wherein either said upper bead or said lower bead is formed as a circular or spherical shape.

4. A footwear according to claim 1, wherein said insole is further formed with a plurality of tenons protruding downwardly from its bottom surface to correspondingly engage a plurality of sockets formed in a sole of a footwear or a slipper.

* * * * *